United States Patent [19]

Shimada et al.

[11] Patent Number: 5,010,411

[45] Date of Patent: Apr. 23, 1991

[54] VIDEO DISPLAY SYSTEM

[75] Inventors: Satoshi Shimada, Kanagawa; Yuji Watanabe, Tokyo, both of Japan

[73] Assignee: Sony Corporation, Tokyo, Japan

[21] Appl. No.: 824,236

[22] Filed: Jan. 30, 1986

[30] Foreign Application Priority Data

Jan. 31, 1985 [JP] Japan ..... 60-017129

[51] Int. Cl.[5] ..... H04N 5/66

[52] U.S. Cl. ..... 358/230; 358/59; 358/240; 358/241

[58] Field of Search ..... 358/56, 59, 230, 240, 358/241; 340/752, 754, 766, 767, 781-805, 701-703, 772, 793, 802; 315/169.1, 169.2, 169.3

[56] References Cited

U.S. PATENT DOCUMENTS 4,368,485 1/1983 Midland ..... 358/240

FOREIGN PATENT DOCUMENTS 0067365 12/1982 European Pat. Off. ..... 358/241

54-48433 4/1979 Japan ..... 358/236

*Primary Examiner*—John W. Shepperd

*Assistant Examiner*—Michael D. Parker

*Attorney, Agent, or Firm*—Hill, Van Santen, Steadman & Simpson

[57] ABSTRACT

A video display device comprising a display panel which has a large number of luminescent display cells arranged in an X-Y matrix and with a common drive circuit for applying an input video signal which substantially reduces the number of drive circuits by at least a factor of two and wherein a switching circuit switches the input video signal from a first plurality of luminescent display cells to adjacent luminescent display cells at every field period of the input video signal so as to reduce at least by one half the number of drive units required in the display device.

4 Claims, 15 Drawing Sheets

FIG. 3A (FP)
FIG. 3B (UCK)
FIG. 3C (ECK)
FIG. 3D (SSP)

FIG. 3F (Data)
FIG. 3G (SSP)
1
2
3
40
32.5
65μ
255 Cycles
1
2
3
18
19
384
385
386
S1
S2
S384
S385
S386

UCK
113
501aB
131
CK
Latch
Counter
INHI.
132
CONT.
LOAD
OUT
S1
FP
Ka
G1
G2
201aB
Ke
201eG
Ka
G1
G2
205aB
135
Ke
205eG
134a
134e
133
134

FIG. 6D Output of 171R,G,B

FIG. 6E Output of 172R,G,B

FIG. 6F Upper Line Display

FIG. 6G Lower Line Display

VIDEO DISPLAY SYSTEM

CROSS-REFERENCES TO RELATED APPLICATIONS

The present application is related to Application 635,608 now U.S. Pat. No. 4,710,765 filed July 30, 1984 entitled "Luminescent Display Cell" assigned to the assignee of the present invention as well as application Ser. No. 689,599 now U.S. Pat. No. 4,682,239 filed Jan. 8, 1985 entitled "Video Display System" assigned to the assignee of the present invention as well as application Ser. No. 694,955 now U.S. Pat. No. 4,686,575 filed Jan. 25, 1985 entitled "Video Display System" assigned to the assignee of the present invention as well as application Ser. No. 694,956, now U.S. Pat. No. 4,649,432, filed Jan. 25, 1985 entitled "Video Display System" assigned to the assignee of the present application as well as application Ser. No. 725,806 now U.S. Pat. No. 4,683,491 filed April 22, 1985 entitled "Display System" assigned to the assignee of the present invention and as well as Application Entitled "Improved Luminescent Display Cell" assigned to the assignee of the present application and identified in the Records of Hill, Van Santen, Steadman & Simpson as P85,1927 in which the inventors are Akio Ohkoshi, Hideaki Nakagawa, Koji Tsuruta and Kunio Shikakura.

BACKGROUND OF THE INVENTION

1. Field of the Invention

This invention relates in general to video display devices which provide a very large picture screen and in particular to an improved driving system for such device.

2. Description of the Prior Art

A video display device has been proposed which uses a large number of luminescent display cells having so-called phosphor trio elements formed of, for example, red, green and blue phosphor layers which are arranged so as to provide a very large picture screen.

As illustrated in FIGS. 18A and B, such luminescent display cell is formed such that the red, green and blue three phosphor layers 2 (2R, 2G and 2B) are surrounded by a carbon layer 3 and are deposited on the inner surface of a front panel 1A of a glass housing 1. Three wire cathodes K ($K_R$, $K_G$ and $K_B$), first grids (control electrodes) $G_1$ ($G_{1R}$, $G_{1G}$ and $G_{1B}$) and a common second grid which is the accelerating electrode $G_2$ are provided in opposing relationship to the color phosphors 2R, 2G and 2B.

The color phosphor layers 2R, 2G and 2B are respectively surrounded by a separator 4 and the electron beams from the respective wire cathodes K are radiated toward or directed individually toward the corresponding phosphor layers 2 In this arrangement, an anode terminal 5 through which an anode voltage is supplied to the phosphor layers 2 is lead out through the separator 4 and between the front panel 1A and a side plate 1C of the glass housing 1 Terminals 6 are provided for the cathodes K, the first grid $G_1$ and the second grid $G_2$ and are lead out between a rear panel 1B and the side plate 1C. In the luminescent display cell, the anode voltage is supplied through the anode terminal 5 to the phosphor layer 2 with the voltages at the anode side and the second grid $G_2$ being fixed and the luminescent display cell is selectively turned on and off by the voltage applied to the first grid $G_1$.

In the above described apparatus, when a picture screen has 144 rows and 192 columns arranged in a matrix, it is required to have a total of 27,648 display cells (144 rows ×192 columns). Also, the number of color elements will be three times that of the number of luminescent cells which will be about 83,000.

In such display devices, different display signals are supplied to each of the 83,000 color elements at the frame rate so as to produce the display in response to the respective display signals. Since the display of each color element comprises the on and off display as described above, the brightness modulation is accomplished with pulse width modulation PWM which controls the on period in response to the display signal supplied.

For this case, however, since the drive circuit including the above-mentioned PWM circuit and the like is relatively expensive because if a drive circuit is provided for each of the 83,000 color elements or luminescent display picture elements, the display device will be bulky and complicated and the price of the device is high. Also, the luminescent display cells generate a large amount of heat during the display operation and if the luminescent display is continuously produced, the luminescent display cells will become very hot Thus, this can cause breakdown of the device due to the high temperatures.

SUMMARY OF THE INVENTION

The present invention relates to a video display device which has a large picture screen and particularly to a video display device in which the drive circuit for applying the input video signal to the plurality of adjacent luminescent display cells in a predetermined direction are commonly used in each of the adjacent luminescent display cells or switched at the field rate with the input video signal so that a good display can be obtained with a very simple structure.

The present invention provides a video display device which includes a display panel in which a plurality of luminescent display cells are arranged in an X-Y matrix form with a common drive circuit for applying an input video signal to a plurality of adjacent luminescent cells arranged in the Y direction and having a switching circuit for switching each of the plurality of adjacent luminescent display cells at the field rate of the video signal so that the same drive circuit can drive twice as many display cells.

According to the present invention, since the number of the drive circuits is reduced to one-half those used in the prior art, a greatly simplified device is obtained and the price will be substantially lowered as compared to the devices of the prior art. Also, the present invention has a greater reliability than those of the prior art since there will be fewer failures due to heat since the present invention operates at a lower temperature than those of the prior art.

Other objects, features and advantages of the invention will be readily apparent from the following description of certain preferred embodiments thereof taken in conjunction with the accompanying drawings although the variations and modifications may be effected without departing from the spirit and scope of the novel concepts of the disclosure and in which:

BRIEF DESCRIPTION OF THE DRAWINGS

FIGS. 3A through 3G are graphs illustrating timing signals according to the invention;

FIGS. 6A through 6I illustrate timing waves of the invention;

DESCRIPTION OF THE PREFERRED EMBODIMENTS

The present applicants have has previously proposed a phosphor display device having a plurality of color picture elements of phosphor trio elements integrally incorporated therein and has demonstrated that a large video display device can be made for practical use by using a phosphor display tube as a single display cell in arranging a number of the luminescent display cells on a suitable support device.

Figure 7:
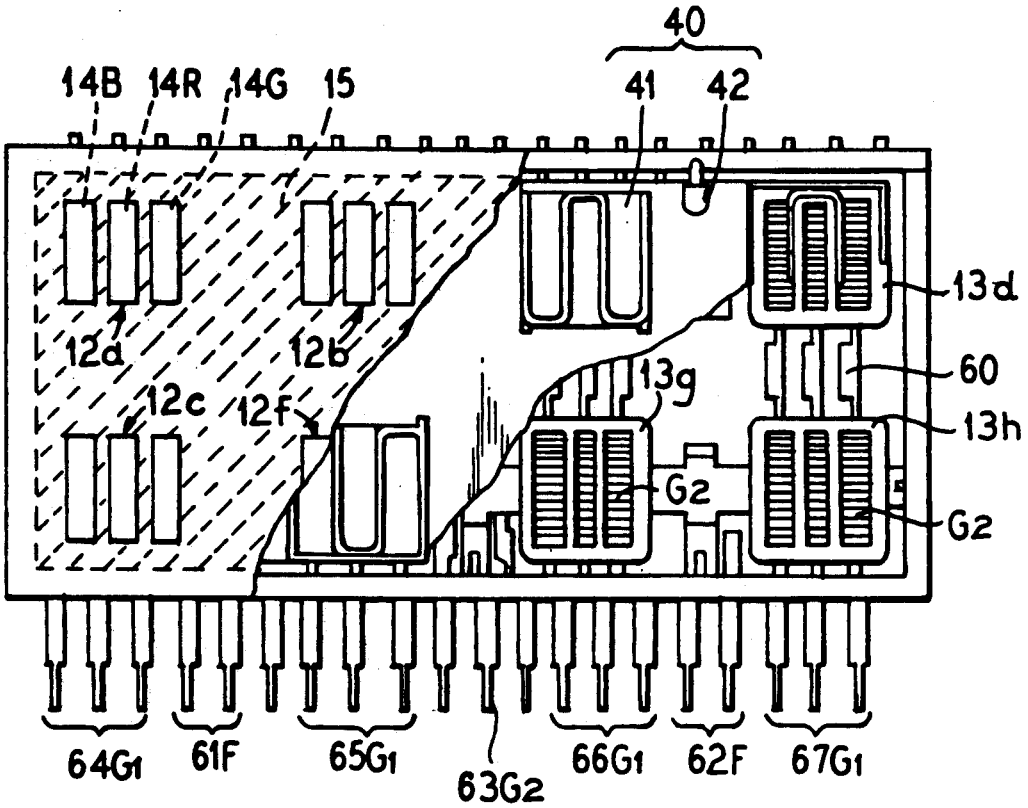
FIG. 7 is a cutaway plan view illustrating a display element having eight three color units therein.
Figure 8:
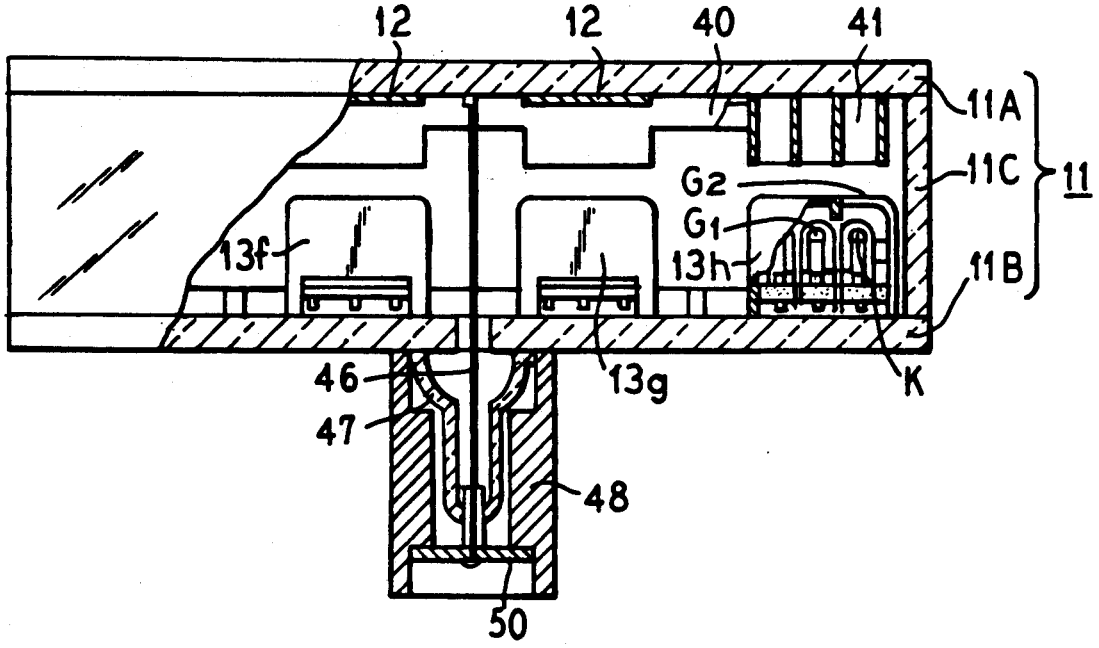
FIG. 8 is a cutaway sectional view illustrating the display unit of FIG. 7.
Figure 9:
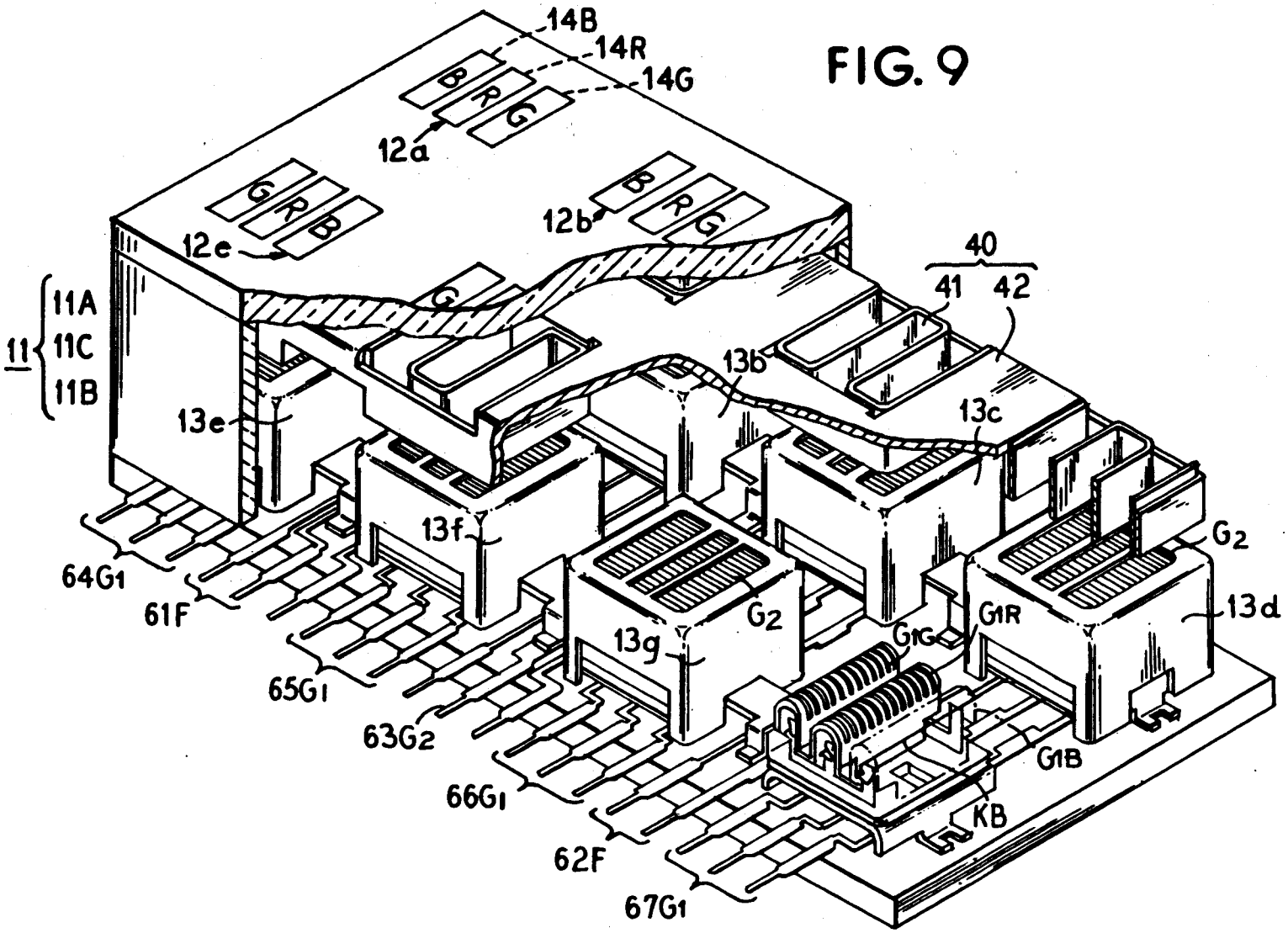
FIG. 9 is a cutaway perspective view illustrating the display apparatus.

The phosphor display tube which will be used in the invention is illustrated in FIG. 7 which is a front view, FIG. 8 which is a side view and FIG. 9 which is a perspective view. The drawings have been partially cutaway in some instances and illustrate a luminescent display tube of the present invention for use as a unitary cell.

As illustrated, a glass housing 11 is composed of a front panel 11A, a back panel 11B and a side wall plate 11C. The glass housing 11 is shaped to have the dimensions of, for example, 41 mm in height and 86 mm width on the front panel 11A. In the glass housing 11, there are arranged eight luminescent trios 12 (12*a*, 12*b*, 12*c*, 12*d*, 12*e*, 12*f*, 12*g*, 12*h*) which function as luminescent display components which are composed of phosphor layers that serve as picture elements and eight electrode units 13 (13*a*, 13*b*, 13*c*, 13*d*, 13*e*, 13*f*, 13*g* and 13*h*) corresponding to the luminescent trios 12.

Figure 10:
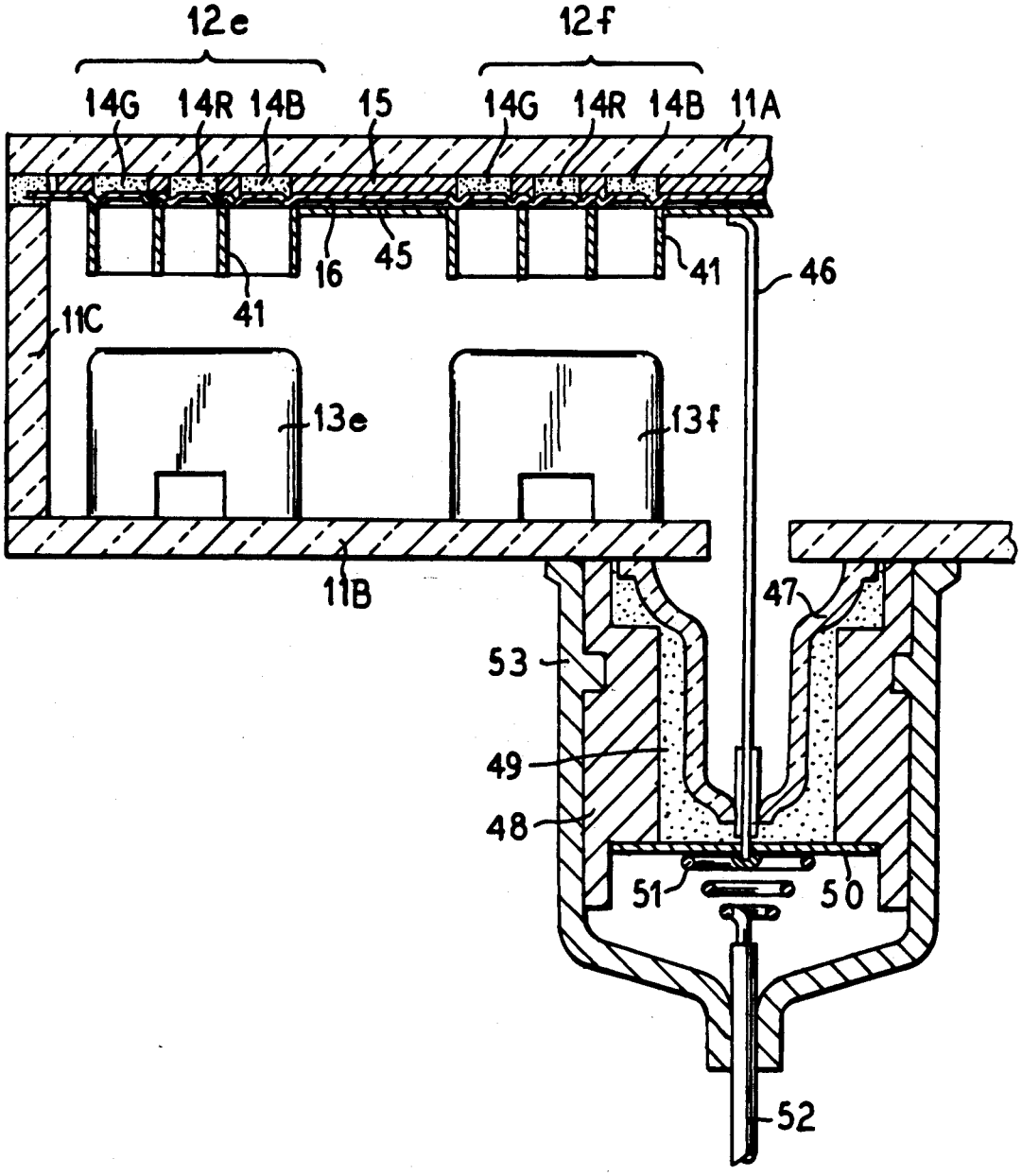
FIG. 10 is a sectional view illustrating the display apparatus.
Figure 11:
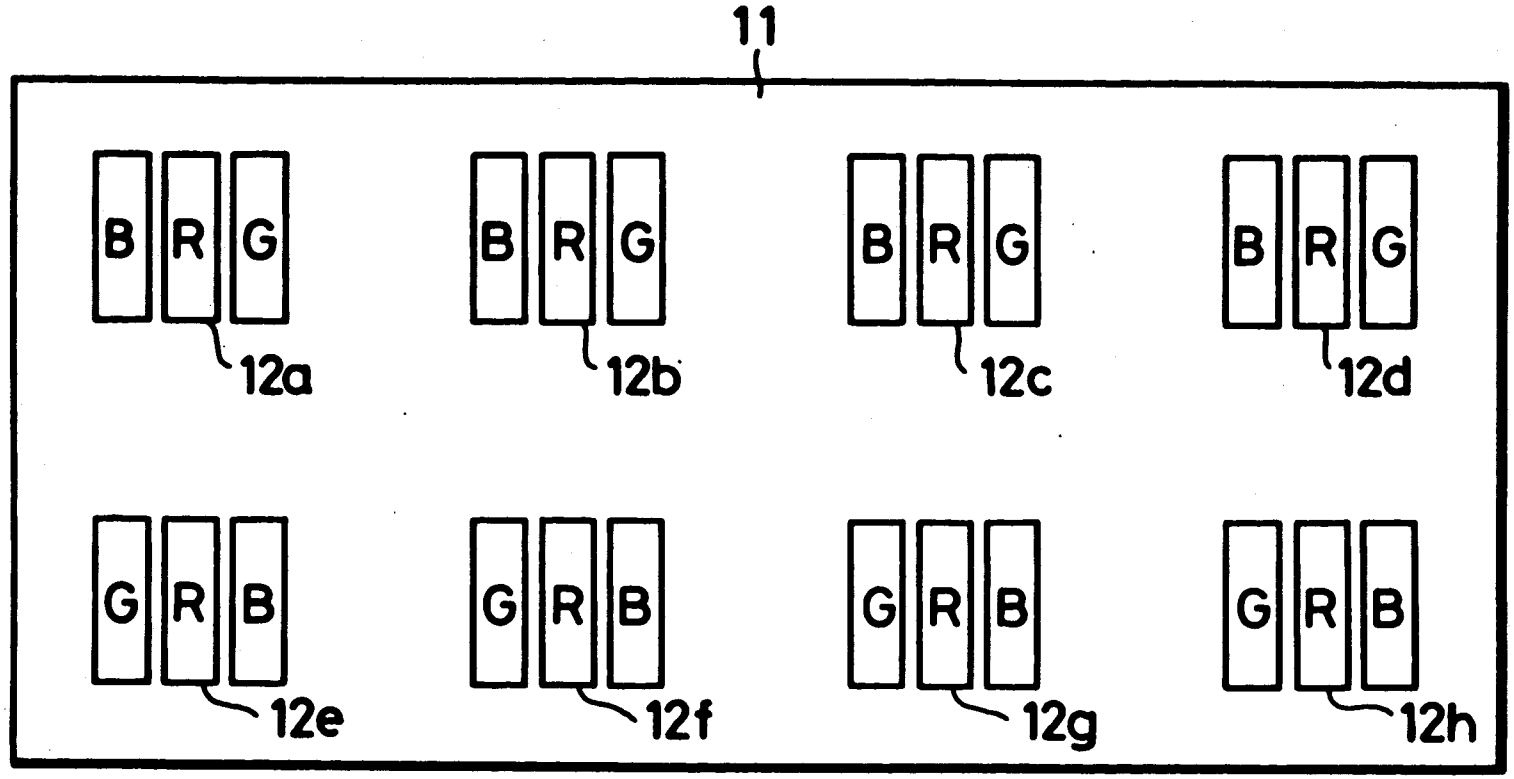
FIG. 11 is a plan view illustrating the display apparatus.

The eight luminescent trios 12 are formed by coating phosphor layers on the inner surface of the front panel 11A in a manner such that four trios are arrayed in each of the upper and lower rows. In a particular example each of the luminescent trios 12 is composed of three phosphor layers 14R, 14G and 14B which respectively emit red, green and blue light. In the configuration as illustrated in FIG. 7, a conductive carbon layer 15 is printed in the shape of a frame on the inner surface of the front panel 11A and the red phosphor layer 14R, green phosphor layers 14G and blue phosphor layer 14B are printed to correspond to individual blank areas in the frame and partially override or overlap the carbon layer 15. As shown in FIG. 10 a metal backing layer 16 of aluminum or the like is deposited through a film layer on the phosphor layers. In each of the luminescent trios 12, the red phosphor layer 14R is disposed at the center and the green phosphor layer 14G and the blue phosphor layer 14B are mounted on the left and right ends respectively and alternate in the arrangement where the blue or green is on the left or right respectively as illustrated in FIG. 11 for example. In such arrangement, the layers 14G and 14B may be reversed every two rows with respect to the right and left ends as illustrated in FIG. 11.

Electrode units 13 are disposed in the proximity of the rear panel 11B at positions opposite to the luminescent trios 12, respectively. In each of the electrode units 13, there are mounted three cathode wires K ($K_R$, $K_G$ and $K_B$) which are mounted opposite respectively to the red phosphor layer 14R, the green phosphor layer 14G and the blue phosphor layers 14B of the luminescent trio 12 respectively and three first grids $G_1$ ($G_{1R}$, $G_{1G}$ and $G_{1B}$) are mounted opposite to the three wire cathodes K respectively and an additional common second grid $G_2$ is mounted in opposing relationship to the three first grids $G_1$.

Figure 12:
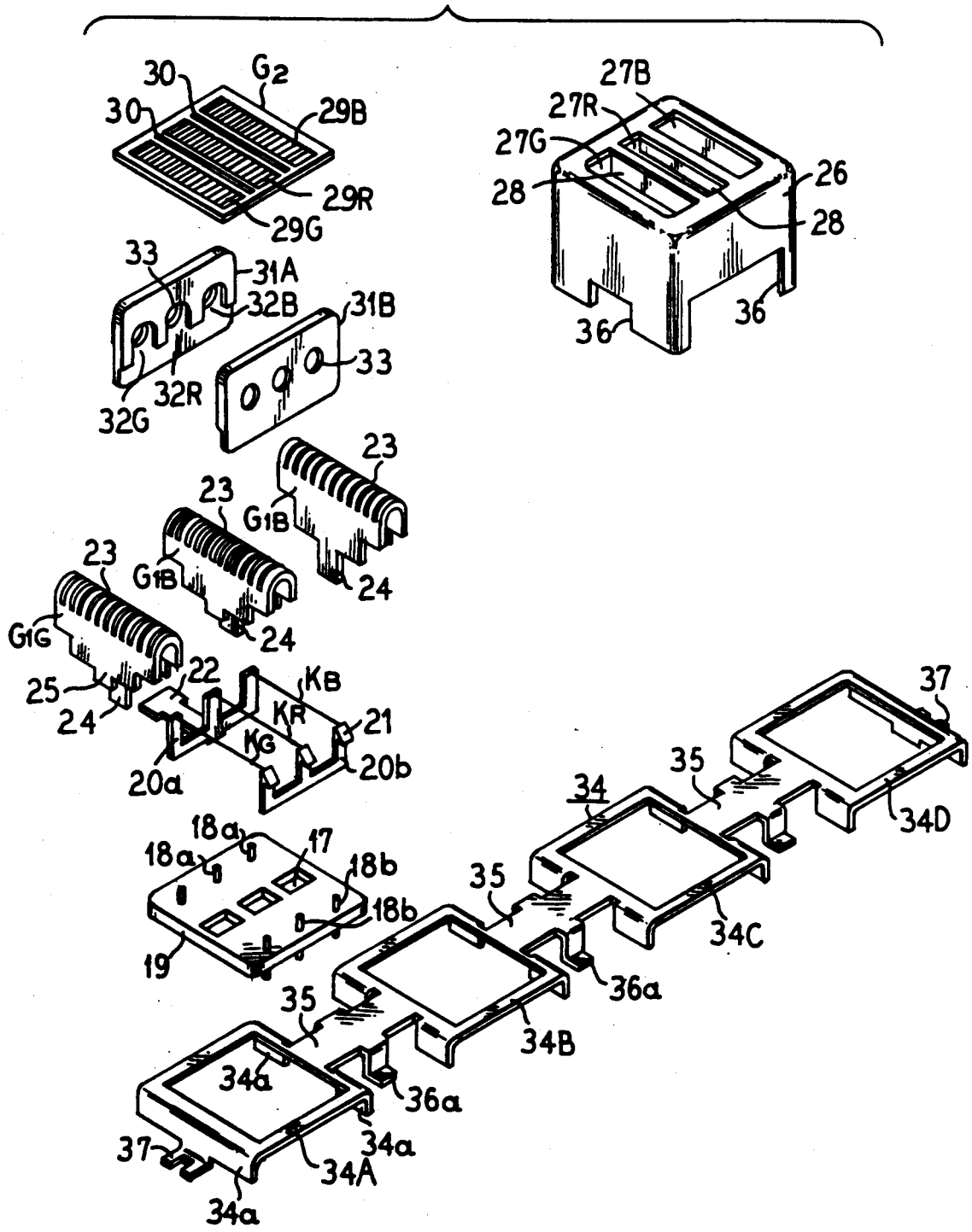
FIG. 12 is an exploded view illustrating a display unit of the invention.
Figure 13C:
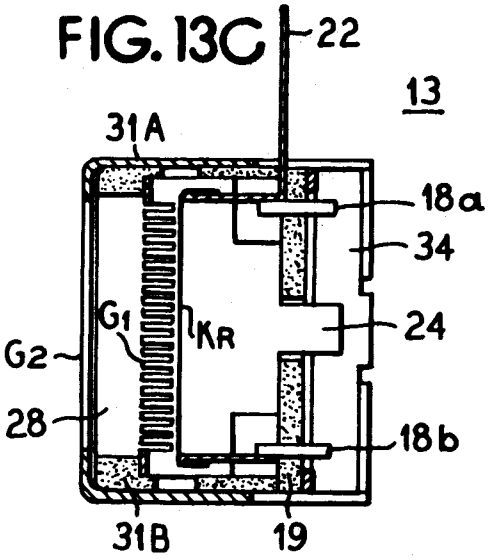
FIGS. 13A, 13B and 13C are respectively detailed views of a display element.
Figure 13A:
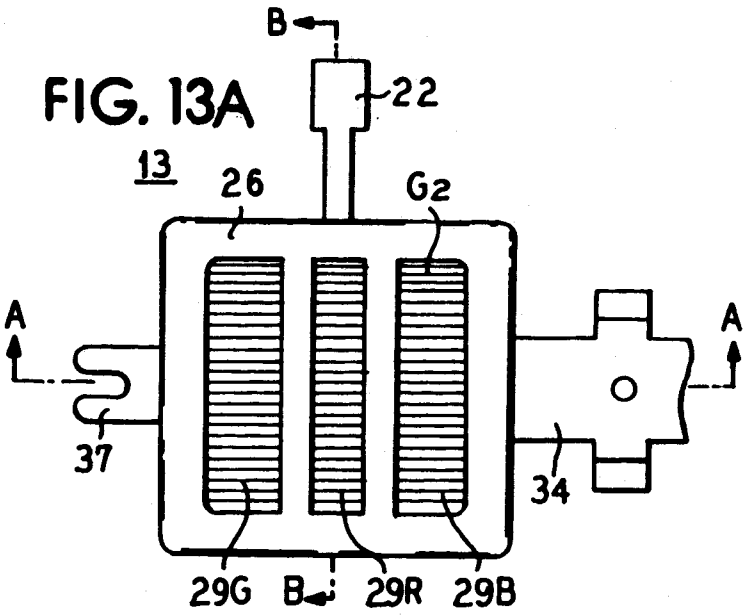
Figure 13B:
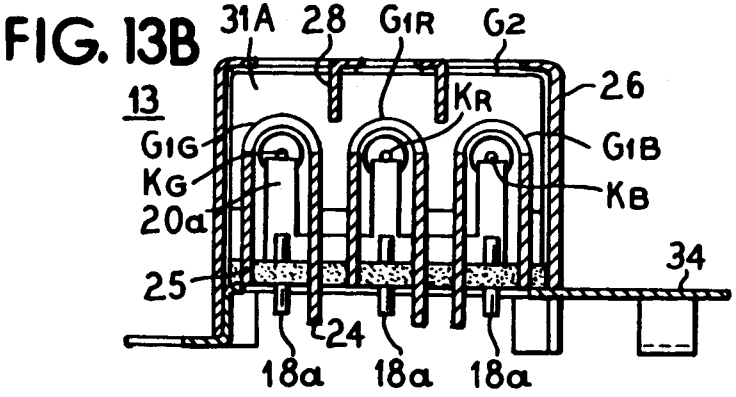

FIGS. 12 and 13A, 13B and 13C illustrate the detail assembly and construction of the electrode unit 13. As shown in FIG. 12, three rectangular openings 17 are formed in a ceramic base 19 at symmetrical positions and pairs of terminal pins 18*a* and 18*b* are mounted in the insulator substrate ceramic base plate 19 as illustrated. A pair of E-shaped conductive support elements 20*a* and 20*b* are connected as by spot welding to the terminal pins 18*a* and 18*b*, respectively, in a manner such that one support element 20*a* is welded in common to the three terminal pins 18*a* arrayed in one row and another support element 20*b* is welded in common to the three terminal pins 18*b* in another row. Wire cathodes $K_G$, $K_R$, and $K_B$ are stretched between the conductive support elements 20*a* and 20*b*. One support element 20*a* serves to anchor one end of each wire cathode K while another support element 20*b* is formed with spring elements 21 each of which is bent outwardly as shown and supports the other end of the wire cathode K such that any expansion of the wire cathode K which may be caused due to temperature change is absorbed by the springs 21 to prevent slack in the wire cathode K. A terminal 22 extends from the support element 20*a* as illustrated. Each wire cathode K is produced by coating for example, the surface of a tungsten heater elements with a carbonate which forms an electron emitting surface.

First grids $G_{1G}$, $G_{1R}$ and $G_{1B}$ are supported in the opening 17 in the ceramic base 19. The grids $G_{1G}$, $G_{1R}$ and $G_{1B}$ are curved so as to have cylindrical surfaces adjacent the wire cathodes $K_G$, $K_R$ and $K_B$ and are formed with a plurality of slits 23 in the cylindrical surfaces at predetermined positions in the longitudinal direction thereof as illustrated. Legs 24 and 25 which are substantially equal in width to the opening 17 extend from the two curved ends in the first grids. The legs 24 and 25 are inserted into the opening 17 of the ceramic base in a manner such that the two legs 24 and 25 press against the inside walls of the opening 17 due to the spring tension in the first grids G. A first leg 24 is longer than leg 25 and the leg 24 serves as a terminal such that when the two legs are inserted into the openings 17, the leg 24 extends therethrough, but the other leg 25 remains within the confines thereof.

Each electrode unit has an enclosure member 26 which is composed of a conductive material and forms a portion of the second grid $G_2$. The enclosure 26 has three rectangular openings 27 ($27_G$, $27_R$ and $27_B$) illustrated in FIG. 12 which are opposite the first grids $G_1$ and separators 28 extend internally as partitions to separate the openings 27 from each other. The enclosure 26 can be formed by a drawing technique and is finished by barrel polishing to eliminate sharp edges which would induce ready electrical discharges. A common second grid $G_2$ is inserted into the enclosure member 26 and has end portions opposite the first grids $G_1$ ($G_{1G}$, $G_{1R}$, $G_{1B}$) and has slit-like meshes $29_G$, $29_R$ and $29_{BN}$ which correspond in position to the slits 23 of the first grid $G_1$. The meshes $29_G$, $29_R$ and $29_B$ are mutually spaced apart by grooves or slots 30 into which the separators 28 are inserted. The second grid $G_2$ is mounted in the enclosure 26 in a manner such that the slit-meshes $29_G$, $29_R$ and $29_B$ align with the openings $27_G$, $27_R$ and $27_B$ respectively and the separators 28 are inserted into the grooves or slots 30. The second grid $G_2$ is spot welded to a portion of the enclosure 26 so that it is connected thereto mechanically and electrically so that the enclosure 26 can serve as the second grid $G_2$.

A pair of insulating separators 31A and 31B are inserted into the enclosure 26 and are positioned along mutually opposed inner walls thereof. In the inner surface regions of the separators 31A and 31B, three grooves 32 ($32_G$, $32_R$ and $32_B$) are formed so as to permit fitting of lateral end portions of the first grids $G_1$ therein. 33 is a through-hole illustrated in FIG. 12. When inserted into the enclosure 26, the separators 31A and 31B are retained in the gap formed between the walls of the enclosure 26 and the separators 28. The upper ends of the separators 31A and 31B are maintained in contact with the second grid $G_2$.

The ceramic base 19 with the wire cathodes K and the first grids $G_1$ attached thereto is inserted into the enclosure 26 in which the second grid $G_2$ and the separators 31A and 31B have been assembled in a manner such that the bottom end faces of the separators 31A and 31B are maintained in contact with the base 19. At this time, the respective two lateral ends of the first grids $G_{1G}$ $G_{1R}$ and $G_{1B}$ are fitted into the grooves $32_G$, $32_R$ and 32B formed in the separators 31A and 31B. Consequently, when the legs 24 and 25 of the first grids $G_1$ are inserted into the openings 17 of the ceramic base 19, lateral end portions of the first grids $G_1$ are fitted into the grooves 32 of the separators 31A and 31B so that they are precisely positioned. A terminal 22 which is bent and extends from one support element 20a where the wire cathodes K are attached is lead out through a recess in the enclosure 26 through a space between the ceramic base 19 and the separator 31a. A retainer assembly 34 is formed of electrically conductive material and one frame shape retainer 34A is fitted into the enclosure 26 and a bent portion 34a of the retainer 34A is spot welded to the enclosure 26 to hold the ceramic base 19 thus forming the electrode unit 13 illustrated in FIGS. 13A, 13B and 13C.

As illustrated in FIG. 12, the conductive retainer assembly 34 consists of retainers 34A, 34B, 34C and 34D in which can be accommodated for enclosure the electrode unit 26 and which are integrally connected with one another by means of conductive connectors 35 which are formed so as to fit into recesses 36 of j the enclosure unit 26. Lugs 36a are provided so that they can be spot welded to a lead frame not shown and attachment lugs 37 provided at opposite ends of the frame 34 so as secured to glass housing 11. Thus, the second grids $G_2$ of the four electrode units 13 ar electrically connected with each other through the conductive retainer assembly 34.

Figure 14:
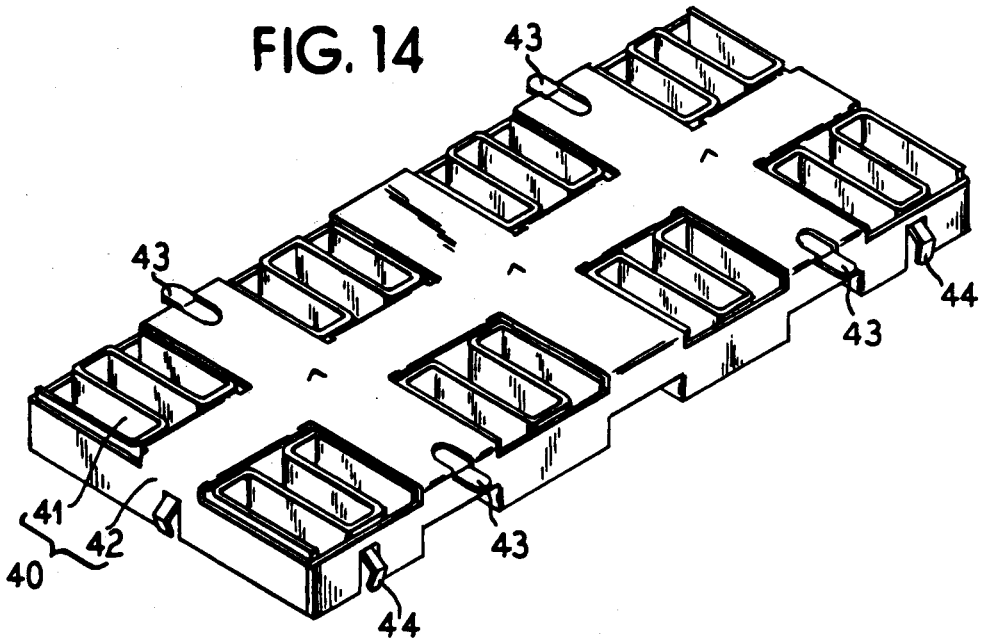
FIG. 14 is a perspective view of a component of the display element.
Figure 15A:
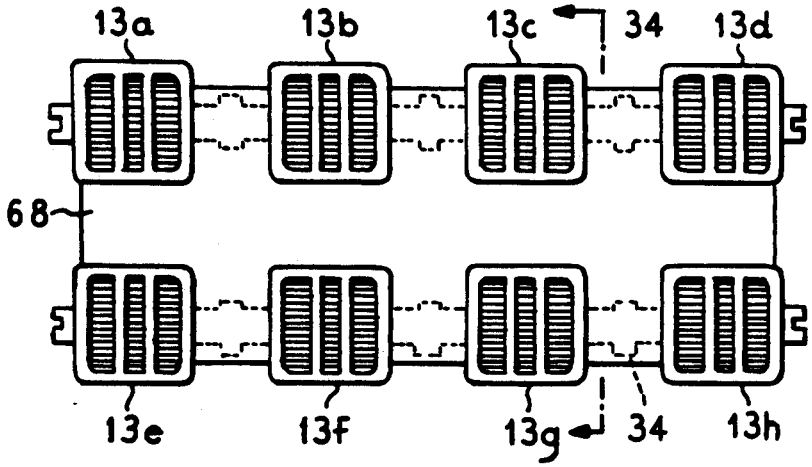
FIG. 15A illustrating eight display elements having three color portions.
Figure 15B:
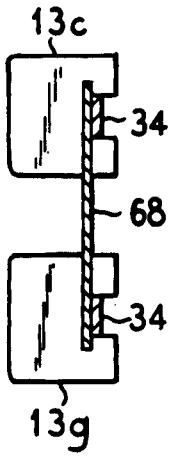
FIG. 15B is an end view of the apparatus illustrated in FIG. 15A.
Figure 16:
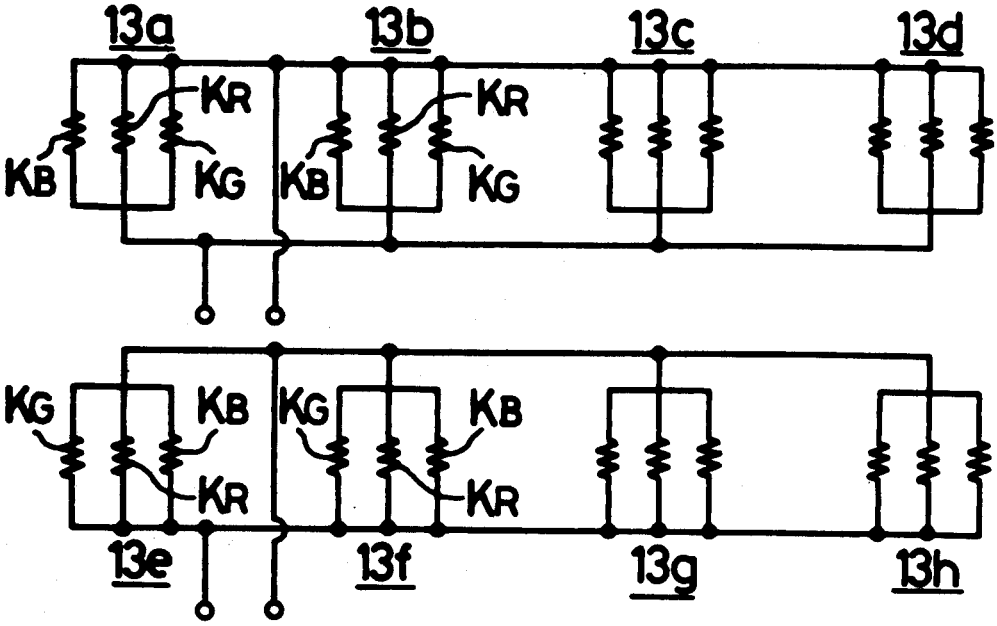
FIG. 16 is an electrical schematic of the display element.

As shown in FIG. 14, a separator assembly 40 of conductive material is positioned so as to surround the phosphor layers 14R, 14G and 14B of eight luminescent trios 12.

The separator assembly 40 functions as a shield to prevent emission of light from the adjacent phosphor layers that may be caused by secondary electrons generated when primary electron beams from the wire cathodes K impinge upon the first grids $G_1$ and the second grids $G_2$. The separator assembly 40 also functions as a diffusion lens which diffuses the electron beams emitted from the wire cathodes K and thus induces radiation of the beams to the whole area of the corresponding phosphor layers 14 while further serving as a power supply means to supply a high voltage such as 8 kV to each luminescent trio 12. In assembling the separator assembly 40 is supported between the front panel 11A and the side wall plate 11C of the glass housing 11 and is secured by the use of glass frit. The separator assembly 40 has separators 41 each shaped into three parts so that the phosphor layers of individual colors are surrounded in eight luminescent trios 12 and the separators 41 are connected integrally with each other through electrode plates 42. The separator assembly 40 has equipped at its upper ends with support fingers 43 which project outwardly. Elastic bent elements 44 for positioning are formed by cutting and raising lateral wall portions of the separator assembly 40. Thus, when the separator assembly 40 is inserted from above relative to the sidewall plate 11C in the glass housing 11, the support fingers 43 will precisely abut against the upper end face of the sidewall plate 11C to support the separator assembly 40 and simultaneously the bent elements 41 will abut against the inner face of the sidewall plate 11C to hold the separator assembly 40 at a predetermined position Also, a projection 45 illustrated in FIG. 10 is formed in a portion of the separator assembly 40 corresponding in position to the electrode plate 42 and when the front panel 11A is superimposed and sealed on the upper end face of the sidewall plate 11C after the separator assembly 40 has been received in the sidewall plate 11C, the projection 45 contacts the metal back layer 16 or the carbon layer 15 so that a high voltage obtained from an anode lead 46 which is the high voltage terminal is applied to the luminescent trios 12 in common. The anode lead 46 is connected at one end to the electrode plate 42 of the separator assembly 40 and the other end is lead out via tip off tube 47 attached to the rear panel 11B of the glass housing 11. The anode lead 46 is composed of Dumet wire (copper alloy) wound with glass in its portron adjacent to the tip off tube 47. Thus, an air-tight condition is maintained between the anode lead 46 and the tip off tube 47. A high voltage cover 48 is secured with an adhesive agent 49 to the exterior of the tip off tube 47 and the anode lead 46 is soldered to an external terminal strip 50 attached to the high voltage cover 48. An external lead 52 is electrically connected to the terminals strip 50 by way of a spring 51 and the high voltage cover 48 is protected by a detachable cover 53 composed of silicon rubber or a similar material.

In the eight electrode units 13 (13*a* through 13*h*) each group of four units are held by a common retainer assembly 34 and then are mounted at predetermined positions on a lead frame 60 to which the attachment lugs 36 of the retainer assembly 34 are spot welded. Then the terminal pins 18 of the wire cathodes K, the legs 24 of the first grids $G_1$ and the retainer assembly 34 of the electrode units 13*a* through 13*d* are connected to the respective leads of the corresponding lead frames by means of lead wires. Then the second grids $G_2$ of the four electrode units 13*a* through 13*d* mounted in one horizontal row are connected to each other by the retainer assembly 34 and the second grids $G_2$ of the four electrode units 13*e* through 13*h* mounted in another row are connected with each other in a similar manner Also, the first grids $G_1$ are mutually connected between every two electrode units arrayed in a vertical column such as between 13*a* and 13*e*, between 13*b* and 13*f*, between 13*c* and 13*g*, and between 13*d* and 13*h* respectively Thus, with respect to the two electrode units mounted in a vertical column, the first grids $G_{1R}$ at the respective centers are mutually connected and similarly the first grids $G_{1B}$ and $G_{1G}$ at the right ends are mutually connected together and also the first grids $G_{1G}$ and $G_{1B}$ at the left ends are mutually connected together. In this particular embodiment, the cathodes K are connected in series with each other.

The respective ends of the wire cathodes K, first grids $G_1$ and $G_2$ are lead out through a sealed region between the rear panel 11B and the bottom end face of the sidewall plate 11C.

There are shown further leads 61F of the wire cathodes; leads 62G of the second grids $G_2$ which are connected between the electrode units 13*e* to 13*h*; leads 63G2 of the second grids $G_2$ connected between the electrodes units 13*a* through 13*d*; leads 64G1 of the three first grids G1 mutually connected between the electrode units 13*a* and 13*e*; leads 65G1 of the three first grids G1 mutually connected between the electrode units 13*b* and 13*f*; leads 66G1 of the three first grids G1 mutually connected between the electrode units 13*c* and 13*g*; and leads 67G1 of the three first grids G1 mutually connected between the electrode units 13*d* and 13*h*.

Figure 17:
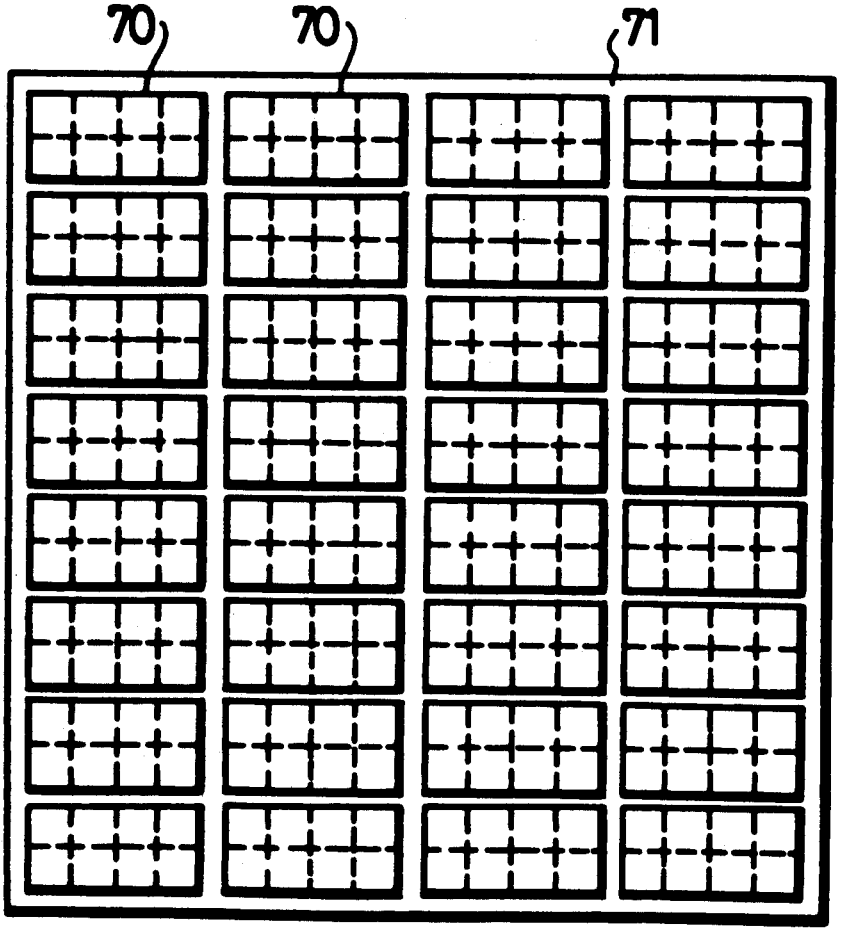
FIG. 17 is a plan view of a display arrangement.
Figure 18A:
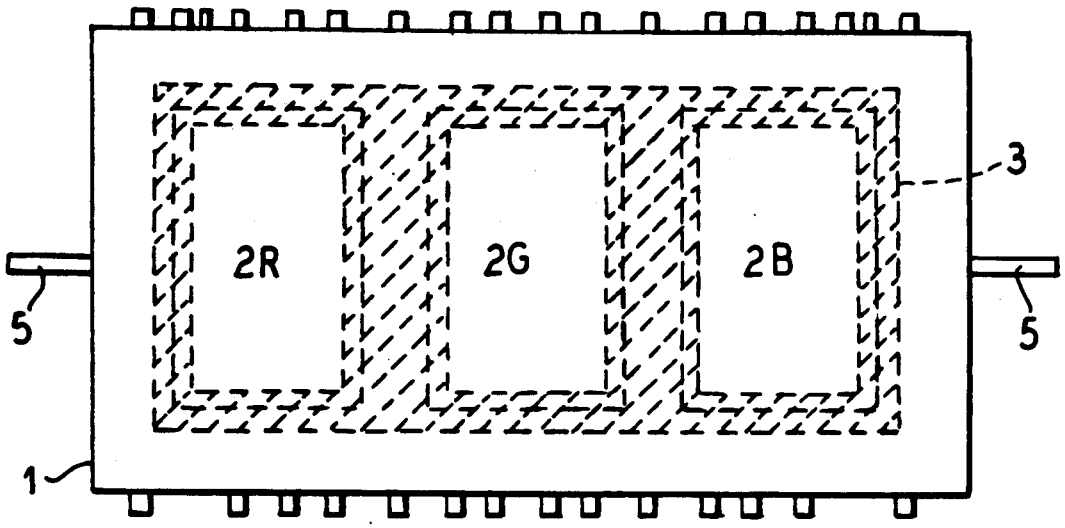
FIG. 18A illustrates in plan view a display element.
Figure 18B:
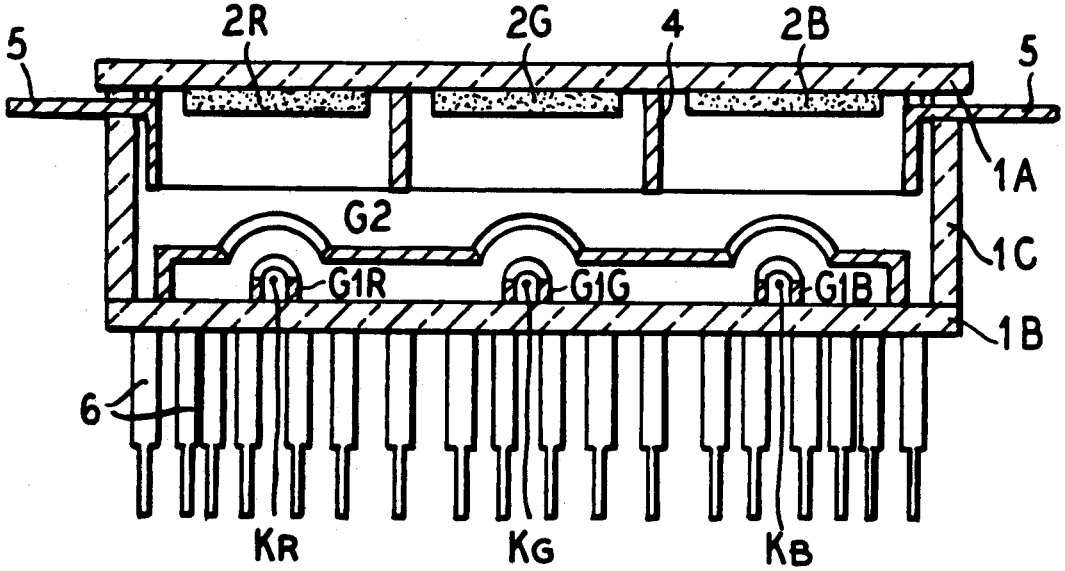
FIG. 18B is a side plan view of the display element illustrated in FIG. 18

The display panel is formed by using the phosphor display tube which has been described as above. As illustrated in FIG. 17, a plurality of, for example, $8\times4=32$ phosphor display tube 70 are incorporated into a unit case 71 which forms one unit. This unit is arranged to be, for example 33.3 cm high and 35 cm wide and is formed so that it can be easily transported and handled Then 108 units such as the unit 71 are assembled with nine units ranged in the column direction and 12 units in the row direction so as to form a large sized video display panel which is 3 m in height and 4.2 m in width. The total number of the luminescent or phosphor trios for such structure can be calculated as follows:

$(8\times2\times9)$ in the column direction $\times(4\times4\times12)$ in the row direction which equals 27,648. Also, the number of picture elements is three times the number of phosphor trios or about 83,000.

The video display panel is formed as described above and in this case since one unit is formed of, for example, 32 phosphor display tubes and the video display panel is assembled by using such units, the handling of the video display device is simple and convenient and the display panel can be easily assembled.

Figure 1:
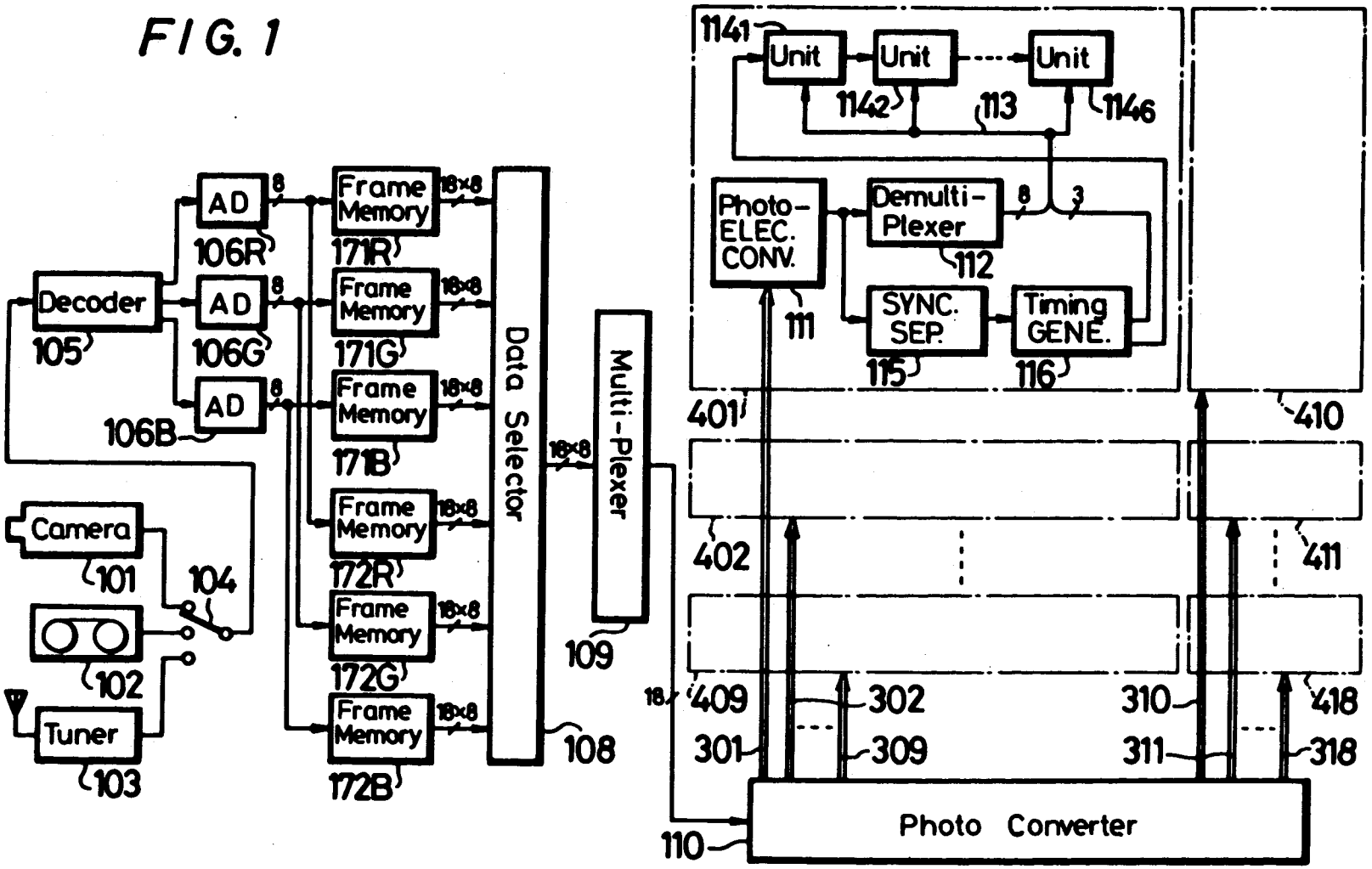
FIG. 1 is a schematic view illustrating the video display device of the invention.

FIG. 1 illustrates a television camera 101, a VTR (video tape recorder) 102, a tuner 103 which produce video signals that can be selected by an input changeover switch 104. Each of the video signals comprise a composite video signal of, for example, the NTSC system. The video signal selected by the switch 104 is supplied to a decoder 105 where it is decoded to the three primary color component signals red, green and blue. These three primary color signals are respectively supplied to A/D (analog to digital) converter circuits 106R, 106G, and 106B and are then converted to, for example, eight bit parallel digital signals.

The digital signals ar alternately supplied to frame memories 171R, 171G and 171B and to frame memories 172R, 172G and 172B. These memories are adapted to accomplish the line conversion to form 72 scanning lines from each single field and the scan conversion processing for doubling the field frequency for example from 60 Hz to 120 Hz. Also, the signal on each of the scanned converted 72 scanning lines is separated into the first half signal and there are derived two outputs for every eight scanning lines and a total of $18\times8$ bit parallel outputs are obtained.

Figure 2:
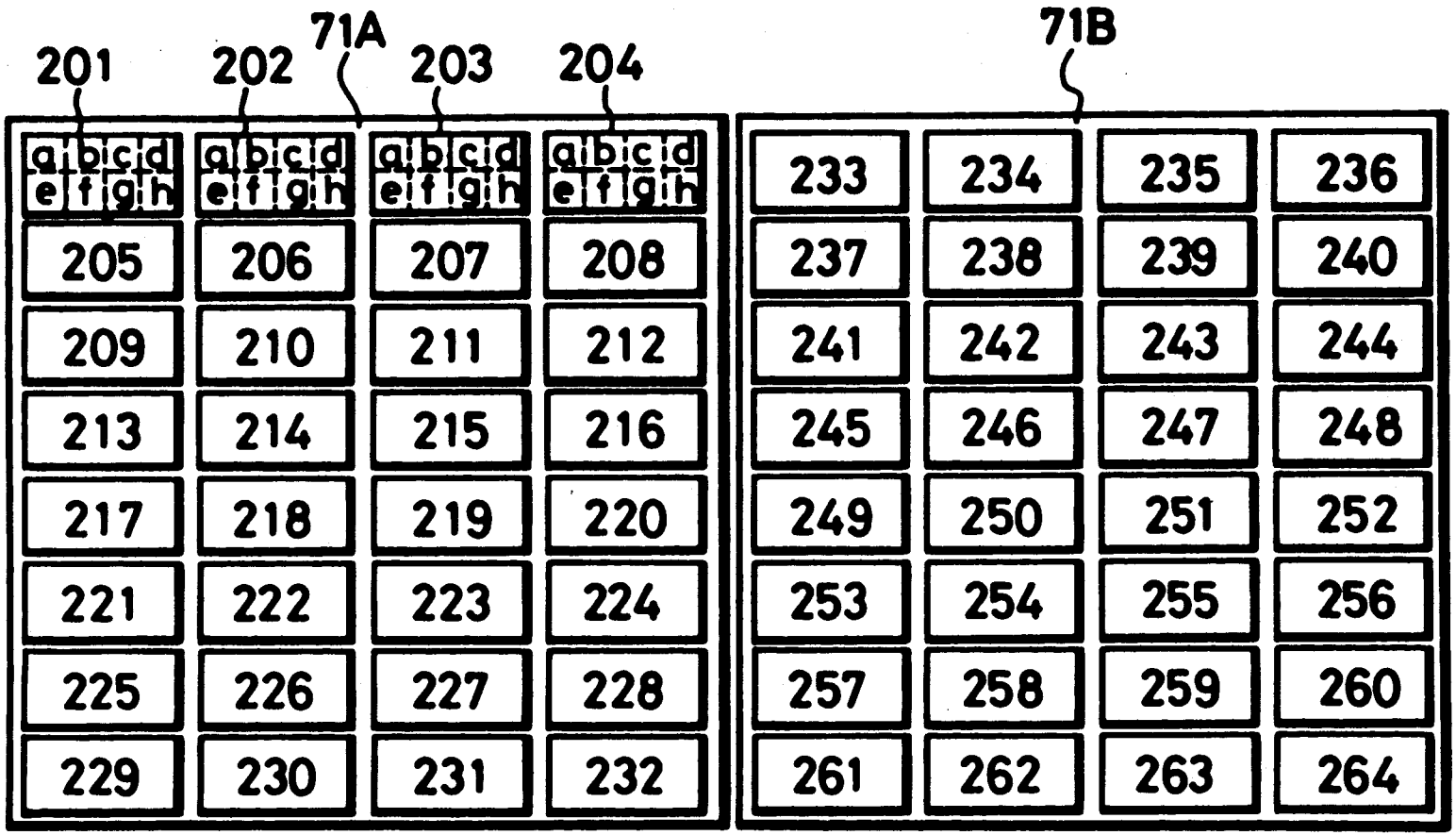
FIG. 2 is a plan view illustrating the luminescent display cells of the invention.

In this case, the manner of deriving the signals from the memories is a specific one such that the signal supply is completed in one unit first and then is completed at every one of the units described previously and signals are supplied to the neighboring units sequentially. That is as shown in FIG. 2 when there are two adjacent units 71A and 71B in one frame, the digital signal of the picture element corresponding to each of the phosphor trios is sequentially derived from one memory group in the respective first half of the odd field and even field in numbered order from 101 to 264. Then after the picture data corresponding to the phosphor trios 13*a* to 13*d* of eight scanning lines 201 to 204, 205 to 208 . . . , 229 to 232 at the left hand side unit 71A have been complete derived, the picture data corresponding to the phosphor trios 13*a* to 13*d* of the eight scanning lines 233 to 236, 237 to 240, . . . , 261 to 264 of the right hand side unit 71B are sequentially derived and then such data will be sequentially supplied to the right hand side unit. The data for the scanning lines formed by the phosphor trios 13*e* to 13*h* are derived from the memory at the latter half of the odd and even fields by interlaced scanning.

The data for the respective picture elements are respectively derived from the respective memories 171R, 171G, 171B or 172R, 172G and 172B at every other frame simultaneously. The picture data are derived at every eight scanning lines for both of the left and right side so that outputs are simultaneously derived. The data delivered are supplied to a data selector 108 illustrated in FIG. 1. In the data selector 108 at every field the red, green and blue data are dot sequentially selected from the memories in which no writing operation is carried out to thereby form the data signal of 18 ($\times8$ bit parallel). Such data signals are fed to a multiplier 109 in which eight bit parallel signals are respectively converted to serial data signals. The signals converted are supplied to a photo converter 110 and then converted to corresponding optical signals.

The optical signals of the former half and of the later half of every eight scanning lines are transmitted through 18 optical filter cables 301, 302, . . . 318 to lateral groups 401, 402, . . . , 409 and 410, 411, . . . 418 of the display device arranged as illustrated.

Also, for example, in the lateral group 401 in the uppermost and left hand side unit, the optical signal from the optical fiber cable 301 is fed to a photo-electric converter 111 and thereby converted to the corresponding electrical signal. This converted data signal is supplied to a demultiplexer 112 in which the serial data signal is converted to the eight bit parallel signal. This data signal is supplied through a bus line 113 to six units $114_1$, $114_2$ . . . $114_6$, which are laterally arranged and in parallel simultaneously.

The signal from the photo-electric converter 111 is supplied to a synchronizing separator circuit 115 in which synchronizing signals are separated, for example, by a data pattern recognition. The synchronizing signal obtained is fed to a timing generator circuit 116 in which there are respectively generated a field pulse signal FP which is inverted every one-half field as illustrated in FIG. 3A, a unit clock pulse UCK which has 255 cycles during a half period (one-half field) of the field pulse signal FP as illustrated in FIG. 3B. Also, produced is a picture element clock pulse ECK which contains 386 cycles during 40 cycles of the unit clock signal UCK as shown in FIG. 3C and a start pulse SSP which has a duration one picture element at every inversion of the field pulse as shown in FIG. 3D. The field pulse, the unit clock pulse and the picture element clock pulse are supplied together with the above data signal through the bus line 113 to the respective units $114_1$, $114_2$, . . . $114_6$ in parallel at the same time while the start pulse SSP is supplied to the first unit $114_1$.

The same operation will be accomplished for each of the eighteen lateral unit groups 401 through 418.

Figure 3E:
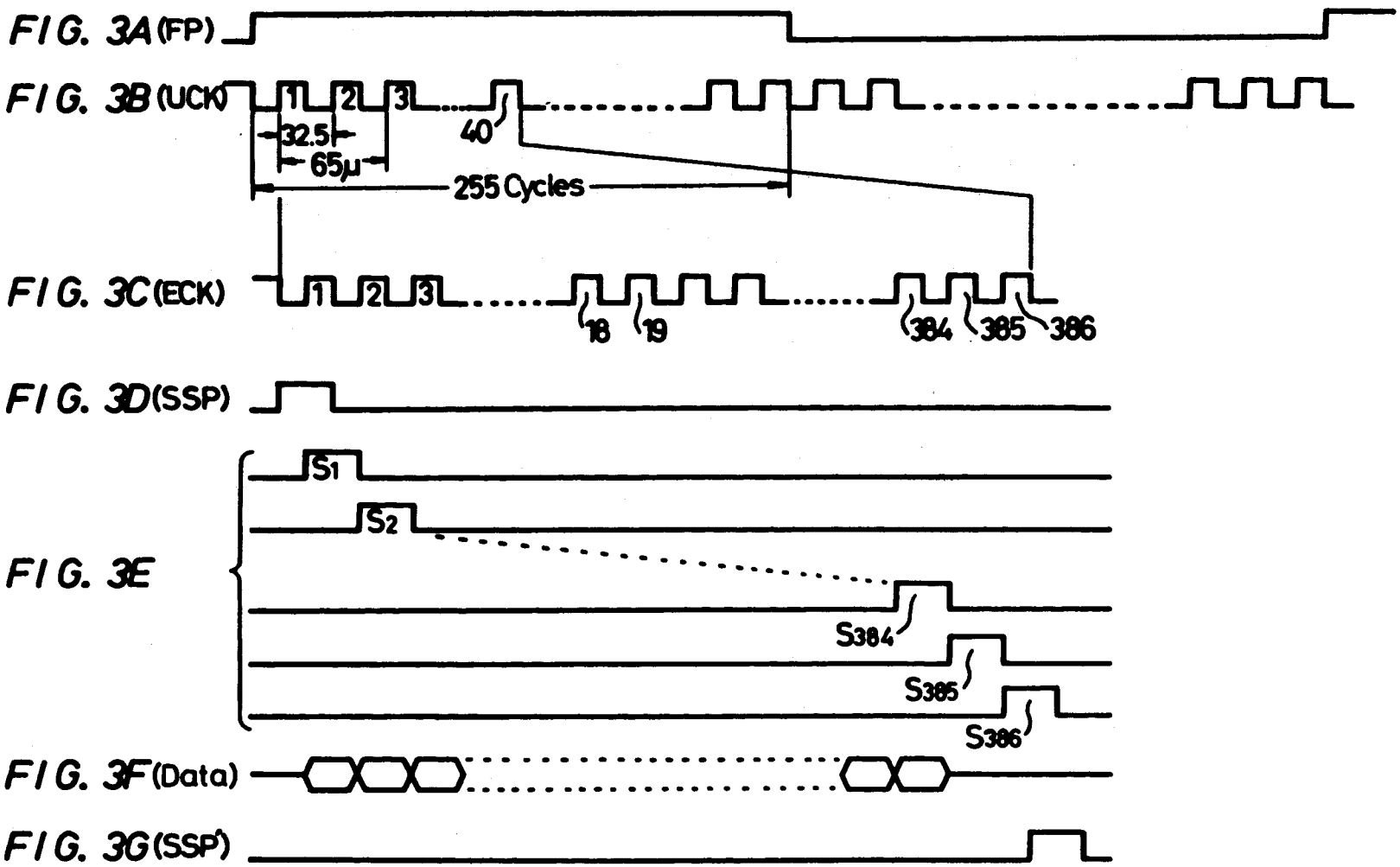
Figure 4:
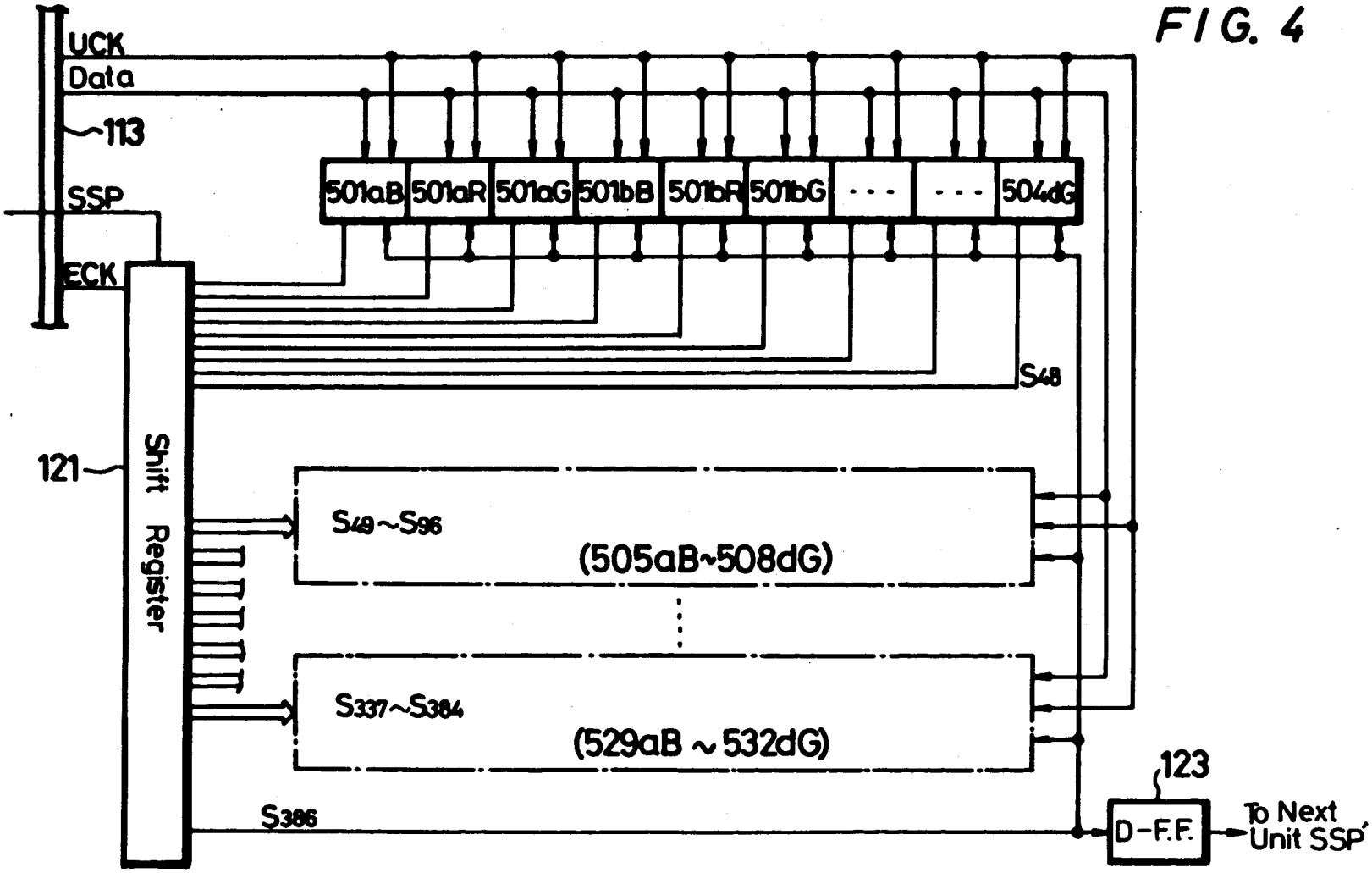
FIG. 4 is a schematic view illustrating the drive circuit of the invention.

In each of the above units, the inside signal is formed as shown in FIG. 4 which illustrates a shift register 121 having 386 stages. The picture element clock pulse ECK from the above timing generator 116 is supplied to the clock terminal of the shift register 121 and the start pulse SSP is supplied to the data terminal of the shift register 121 Then from the respective stages of the shift register 121 there are delivered signals $S_1$, $S_2$, . . . , $S_{386}$ which are sequentially shifted as illustrated in FIG. 3E. The signals $S_1$ to $S_{384}$ are sequentially supplied to latch circuits 501*a*B through 532*d*G that are respectively provided in the picture elements 201*a*B, 201*a*R, 201*a*G, 201*b*B to 201*b*G, . . . , 201*d*B to 201*d*G, 202*a*B to 202*a*G, . . . , 202*d*B to 202*d*G, . . . , 232*a*B to 232*d*G of the phosphor trios 13*a* to 13*d* and in the picture elements 201*e*G, 201*e*R, 201*e*B, 201*f*G to 201*f*B, . . . , 201*h*G to 201*h*B, 202*e*G to 202*h*B, . . . , 232*e*G to 232*h*B of the phosphor display trios 13*a* to 13*h* of the respective phosphor tubes 201 to 232. In FIG. 4, the circuits in the one dot chain line blocks are equivalent to the above circuit The data signal from the bus line 113 as shown in FIG. 3F is supplied to the latch circuits 501*a*B to 533*d*G in parallel. Also, the signal $S_{386}$ from the register 121 is supplied to a D-type flip-flop circuit 123 which forms a start pulse SSP' illustrated in FIG. 3G and which will be fed to the next unit.

Figure 5:
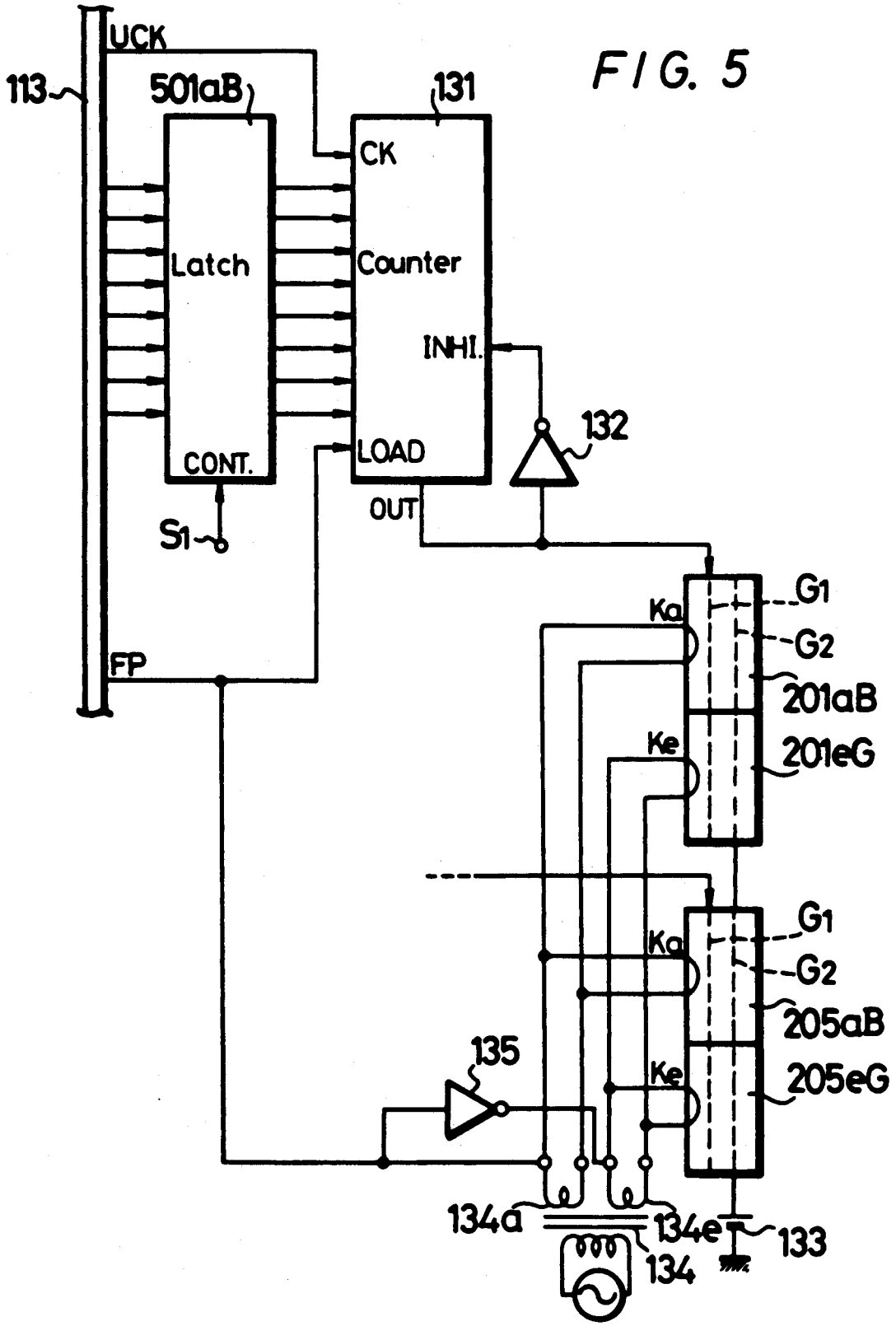
FIG. 5 is an enlarged detailed view of the drive circuit of FIG. 4 illustrating the invention.

FIG. 5 illustrates the novel features of the present invention and in each picture or color element, the inside signal system is constructed as illustrated in FIG. 5. FIG. 5 illustrates the picture elements 201*a*B and 201*e*G in its upper portion. There is provided the eight bit latch circuit 501*a*B. The data signal from the bus line 113 is supplied to the data terminal of the latch circuit 501*a*B and the signal S1 is fed to the control terminal of the latch circuit 501*a*B. There is also provided an eight bit down counter 131 and the output from the latch circuit 501*a*B is fed to the preset terminal of the counter 131.

The leading edge and the trailing edge of the field pulse from the bus terminal 113 are detected and these signals are fed to a load terminal of the counter 131 and the unit clock signal UCK is fed to the clock terminal of the counter 131 which generates an output signal which indicates that the contents of the counter 131 are not all zeros. The signal which indicates the fact that the contents of the counters are not all zero is phase inverted by an inverter 132 and then fed to a count inhibit terminal of the counter 131

Thus, the above-described circuits allows the data from the bus line 113 to be latched in the latch circuits 501*a*B to 532*d*B of the corresponding picture elements at timings of the signals $S_1$ to $S_{384}$, preset in the counter 131 at the timings of the leading edge and the trailing edge of the field pulse FP and then counted down until the counter 131 is all zeros whereby the counter 131 forms PWM signals (pulse width modulated signals) corresponding to the respective data. Since the counter 131 counts down by the unit clock signal UCK and the unit clock has 255 cycles during one field, the display cell is continuously rendered luminous during one field at the maximum value of the data producing 256 gradiations until the display cell is not rendered luminous anymore.

Also, at the timing of the signal $S_{386}$, the start pulse of the next unit is generated and the same operation will sequentially be carried out for six units that are laterally arranged. The data is latched in each unit during the period of 40 cycles of the unit clock UCK Thus, 250 cycles are required to complete the data latch for six units that are arranged in the lateral direction. Thus, it is possible to transmit special control signals such as the synchronizing signal and other signals by using the remaining 15 cycles.

The output signal from the counter 131 is supplied to the left end of the lead wire $64G_1$ of the first grids $G_{1a}$ and $G_{1e}$ corresponding to the picture elements 201*a*B and 201*e*G at the left end of the phosphor display tube 101. The lead wire $63G_2$ of the second grid $G_2$ is supplied with a predetermined constant voltage from a constant voltage source 133. Also, a predetermined heating current flows through the cathode Ka and Ke to which a switching bias voltage which has its polarity inverted at every one half field is supplied and which is superimposed on the heating current.

Thus, relative to FIG. 5, an AC current of, for example, 50 to 100 kHz is supplied to the primary winding of a transformer 134 and currents induced in two field coils 134*a* and 134*e* comprising the secondary coils of the transformer are supplied to the cathodes Ka and Ke. At the same time, the field pulse FP from the bus line 113 is directly supplied to one end of the coil 134*a* and is also passed through the inverter 135 to invert it and then fed to one end of the coil 134*e*.

Consequently, a switching voltage of, for example, 0 to 5 volts is supplied to the wire cathode as a row selecting voltage and a drive voltage of 0 to 5 volts is supplied to the first grid $G_1$. Also, a fixed voltage of lower than 10 volts is commonly supplied to the second grids $G_2$ of the respective electrode units 13*a* to 13*h*. Thus, under the state that 0 volts is supplied to the wire cathodes K of the electrode units 13*a* to 13*d* and, for example, the upper row and that a cutoff voltage of, for example, five volts is supplied to the wire cathodes K of the electrode units 13*e* to 13*h* of the lower row, when the voltage of, for example, 5 volts is supplied through the lead wire 64$G_1$ to the first grid $G_1$, the first phosphor trio 12*a* will be made luminous. When 0 volts is supplied to the first grid $G_1$, the electron is cut off so that the corresponding phosphor layer will not be luminous. If the voltage is sequentially fed through the lead wires 64$G_1$, 65$G_1$, 66$G_1$ and 67$G_1$ to the first grids $G_1$ the phosphor trios 12*a* to 12*d* of the upper row will be made luminous. If the switching voltage for the wire cathodes K is switched and 0 volts is supplied to the wire cathodes K of the lower row, sequentially supplying the voltage 5 V of the first grid $G_1$ to the lead wires 64$G_1$ to 67$G_1$ in this order will render the phosphor trios 12*e* to 12*h* of the lower row luminous.

Thus, the display is carried out by six units that are arranged in the horizontal direction. Also, the above operation is carried out in parallel in nine unit groups that are arranged in the vertical direction and also in nine other unit groups of the right hand side so that the whole picture is displayed.

In this manner, a large picture is displayed on the display panel of, for example, three meters height by 4.2. meters width. According to the above-mentioned device one system of the drive circuit formed of the latch circuit and counter may be sufficient for two picture elements that are adjacent to each other in the vertical direction and it is possible to reduce the number of drive circuits to one-half. Therefore, in the display panel according to the invention, only about 41,500 drive circuits are necessary for 83,000 color or picture elements. Thus, the present invention reduces the drive circuits by one-half.

Relative to the adjacent picture elements since one is turned on and the other is turned off at every one-half field, the heat generated in the display operation will be reduced to one-half relative to prior art devices, thus, reducing temperature rise.

Figure 6A:
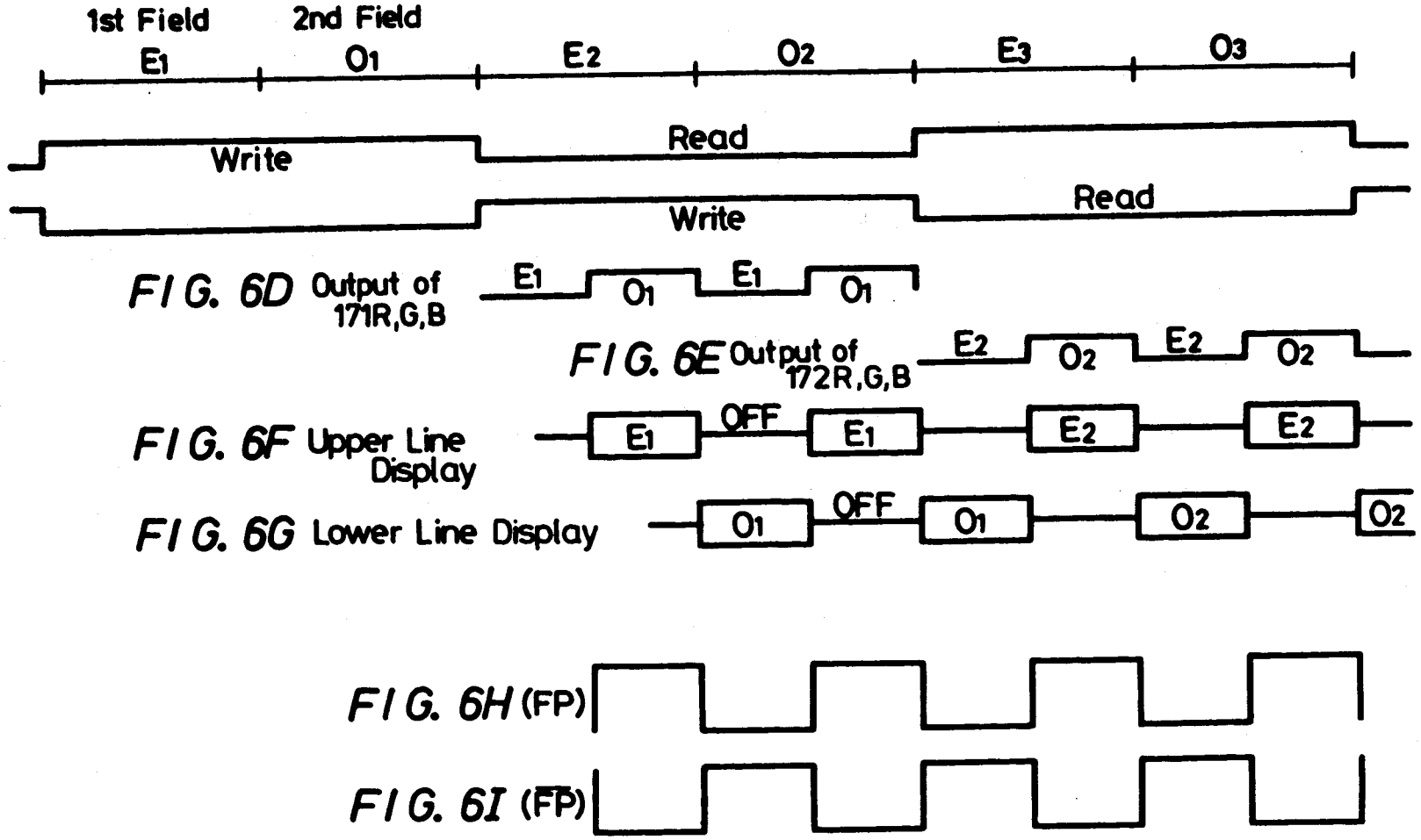

Also, in the device of the invention, the so-called interlace scanning is carried out. In this case, since the vertical scanning line is scanned converted by double of the frame memories 171R to 171B and 172R to 172B as shown in FIGS. 6A through 6G and the field pulse FP shown in FIG. 6H and 6I is generated in synchronism therewith, the vertical frequency display becomes 120 Hz which reduces problems such as the decrease in brightness due to the interlace scanning and the flicker is greatly reduced.

According to the present invention, since the number of drive circuits are reduced to one-half, the device can be simplified in construction and the price of the device will be substantially lowered and is also more reliable since breakage caused by heat generation does not occur.

Although the invention has been described with respect to preferred embodiments, it is not to be so limited as changes and modifications will be made therein which are within the full intended scope as defined by the appended claims.

We claim as our invention:

1. A video display system comprising: a video signal source for supplying a video signal; a plurality of display cells arranged in rows and columns in an X-Y matrix form; and a plurality of driving circuits for driving said plurality of display cells in response to said video signal, characterized in that each of said driving circuits is provided to commonly drive a plurality of said display cells adjacent to each other in the column direction, and switching means provided for switchably activating different ones of said plurality of said display cells cyclically at a field rate of said video signal, wherein said plurality of the display cells adjacent to each other are two neighboring display cells in the column direction, and wherein each of said driving circuits includes a scanning converter for doubling the vertical frequency of said video signal; and a pulse width modulation circuit responsive to said converted video signal for deriving a PWM signal corresponding to the brightness level of said converted video signal.

2. A video display system according to claim 1 wherein said switching means applies a field rate switching signal to switching electrodes of said adjacent two neighboring display cells.

3. A video display system according to claim 1 wherein said display cells are red, green and blue cells arranged cyclically in row and column directions, and said video signal includes red, green and blue signals which are separately applied to the red, green and blue display cells, respectively

4. A video display system according to claim 3 wherein each of said display cells is a fluorescent display tube having a filament electrode, a grid electrode and a fluorescent screen; each of said driving circuits commonly drives the grid electrodes of said adjacent two neighboring display tubes; and said switching means applies a field rate switching signal to the filament electrodes of said adjacent two neighboring display tubes.

* * * * *